US008015963B2

(12) United States Patent
Elkolaly

(10) Patent No.: US 8,015,963 B2
(45) Date of Patent: Sep. 13, 2011

(54) FUEL PRESSURE CONTROL STRATEGY AT ENGINE SHUTDOWN

(75) Inventor: Omar Elkolaly, Ann Arbor, MI (US)

(73) Assignee: GM Global Technology Operations LLC (US)

( * ) Notice: Subject to any disclaimer, the term of this patent is extended or adjusted under 35 U.S.C. 154(b) by 292 days.

(21) Appl. No.: 12/407,190

(22) Filed: Mar. 19, 2009

(65) Prior Publication Data

US 2010/0236528 A1 Sep. 23, 2010

(51) Int. Cl.
*F02M 51/06* (2006.01)
*F02M 51/00* (2006.01)

(52) U.S. Cl. ..... 123/479

(58) Field of Classification Search ..... 123/479, 123/478, 456, 198 D, 459; 701/103, 112, 701/114; 73/114.38, 114.43, 114.45
See application file for complete search history.

(56) References Cited

U.S. PATENT DOCUMENTS 5,633,458 A * 5/1997 Pauli et al. ..... 73/114.51

* cited by examiner

*Primary Examiner* — Mahmoud Gimie

(57) ABSTRACT

A fuel system control method may include determining when an engine transitions from an engine on condition to an engine off condition. The method further includes determining a first fuel pressure in a fuel system of the engine a predetermined time after the determined engine off condition. A fuel injector of the fuel system may be actuated during the engine off condition when the first determined fuel pressure is above a first predetermined pressure limit to bleed fuel from the fuel system and reduce pressure within the fuel system.

20 Claims, 3 Drawing Sheets

FUEL PRESSURE CONTROL STRATEGY AT ENGINE SHUTDOWN

FIELD

The present disclosure relates to fuel system control strategies.

BACKGROUND

This section provides background information related to the present disclosure which is not necessarily prior art.

Engines may include fuel pressure sensors to determine and control operating pressures therein. After engine shutdown, high pressure fuel systems may bleed fuel from the system through clearances in the fuel injectors. However, some fuel types may have difficulty leaking through the fuel injectors after engine shutdown. This may hinder service of the fuel system due to high pressure being maintained after engine shutdown. Additionally, this may result in longer than expected leak times and may set a false error indicating a pressure sensor failure.

SUMMARY

This section provides a general summary of the disclosure, and is not a comprehensive disclosure of its full scope or all of its features.

A fuel system control method may include determining when an engine transitions from an engine on condition to an engine off condition. The method further includes determining a first fuel pressure in a fuel system of the engine a predetermined time after the determined engine off condition. A fuel injector of the fuel system may be actuated during the engine off condition when the first determined fuel pressure is above a first predetermined pressure limit to bleed fuel from the fuel system and reduce pressure within the fuel system.

The method may additionally include determining a second fuel pressure in the fuel system after the actuating and indicating a system fault when the second fuel pressure is above a second predetermined pressure limit.

A control module may include an engine operating condition evaluation module, a fuel pressure determination module, and a fuel injector actuation module. The engine operating condition evaluation module may determine when an engine transitions from an on condition to an off condition. The fuel pressure determination module may be in communication with the engine operating condition evaluation module and may determine a first fuel pressure in a fuel system of the engine a predetermined time after the determined engine off condition. The fuel injector actuation module may be in communication with the fuel pressure determination module and may actuate a fuel injector of the fuel system during the engine off condition when the first determined fuel pressure is above a first predetermined pressure limit to bleed fuel from the fuel system and reduce pressure within the fuel system.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
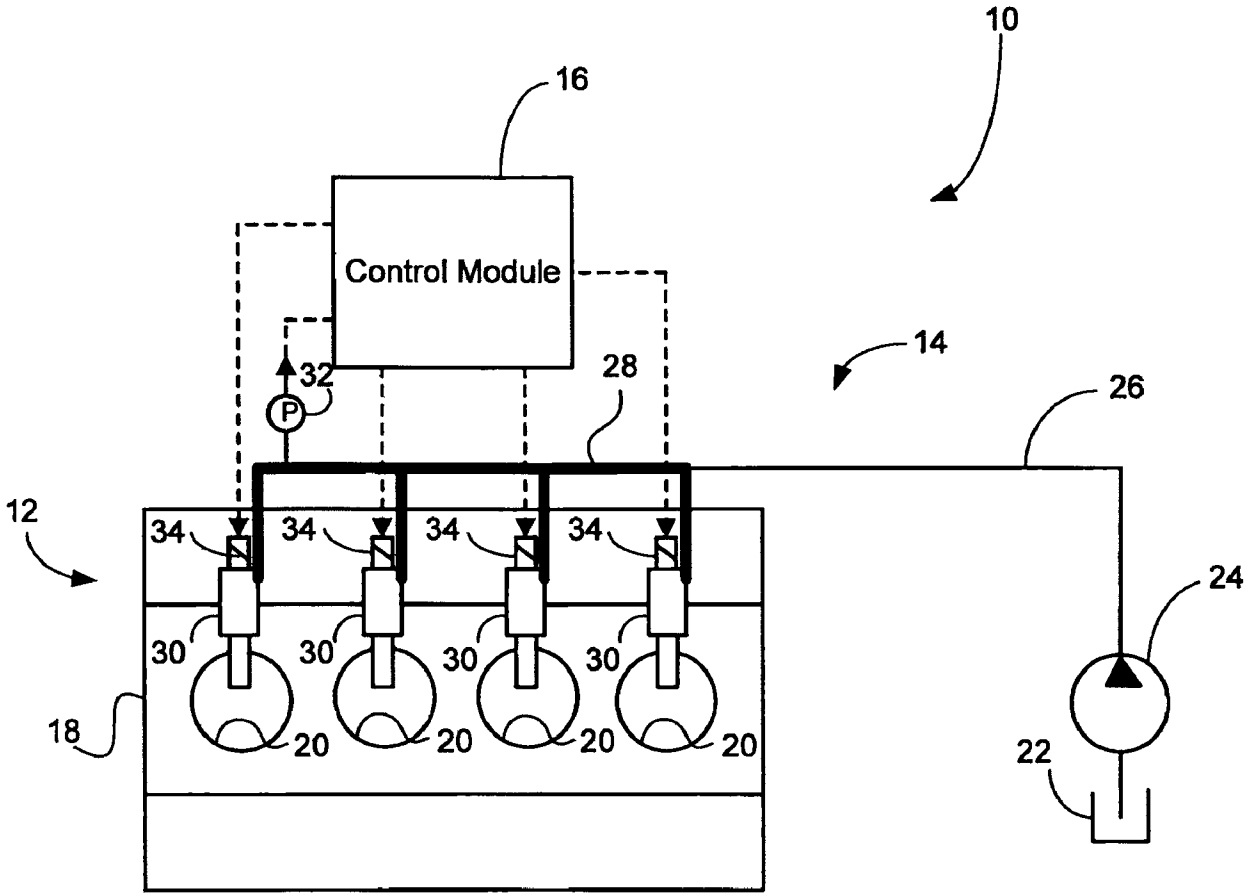
FIG. 1 is a schematic illustration of an engine assembly according to the present disclosure.

The following description is merely exemplary in nature and is not intended to limit the present disclosure, application, or uses. For purposes of clarity, the same reference numbers will be used in the drawings to identify similar elements. As used herein, the term "module" refers to an application specific integrated circuit (ASIC), an electronic circuit, a processor (shared, dedicated, or group) and memory that execute one or more software or firmware programs, a combinational logic circuit, or other suitable components that provide the described functionality.

Referring to FIG. 1, an exemplary engine assembly 10 is schematically illustrated. The engine assembly 10 may include an engine 12 in communication with a fuel system 14 and a control module 16. The engine 12 may include an engine block 18 defining a plurality of cylinders 20 in communication with the fuel system 14.

The fuel system 14 may include a fuel tank 22, a fuel pump 24, a fuel line 26, a fuel rail 28, fuel injectors 30, and a pressure sensor 32. The fuel injectors 30 may be in direct communication with the cylinders 20, forming a direct injection arrangement. More specifically, the engine 12 may be a diesel engine and the fuel tank 22 may store a supply of diesel fuel. The fuel injectors 30 may be solenoid actuated, each including a solenoid 34 in communication with the control module 16 and selectively displacing a valve member (not shown) in the fuel injector 30 to provide a pressurized fuel flow to the cylinders 20. However, while described with respect to a diesel engine, it is understood that the present disclosure is not limited to diesel applications.

During operation, the fuel pump 24 may provide a pressurized fuel flow from the fuel tank 22 to the fuel rail 28 via the fuel line 26. The fuel line 26 and the fuel rail 28 may define a fuel volume (V) between the fuel pump 24 and the fuel injectors 30. During engine operation, the fuel volume (V) may be maintained at a pressure greater than 30 megapascal (MPa). For example, the pressure within the fuel volume (V) during engine idle conditions may be greater than 30 MPa. The pressure sensor 32 may be in communication with the fuel volume (V) to monitor the fuel pressure. In the present example, the pressure sensor 32 is in communication with the fuel rail 28 and monitors the fuel pressure therein.

Figure 2:
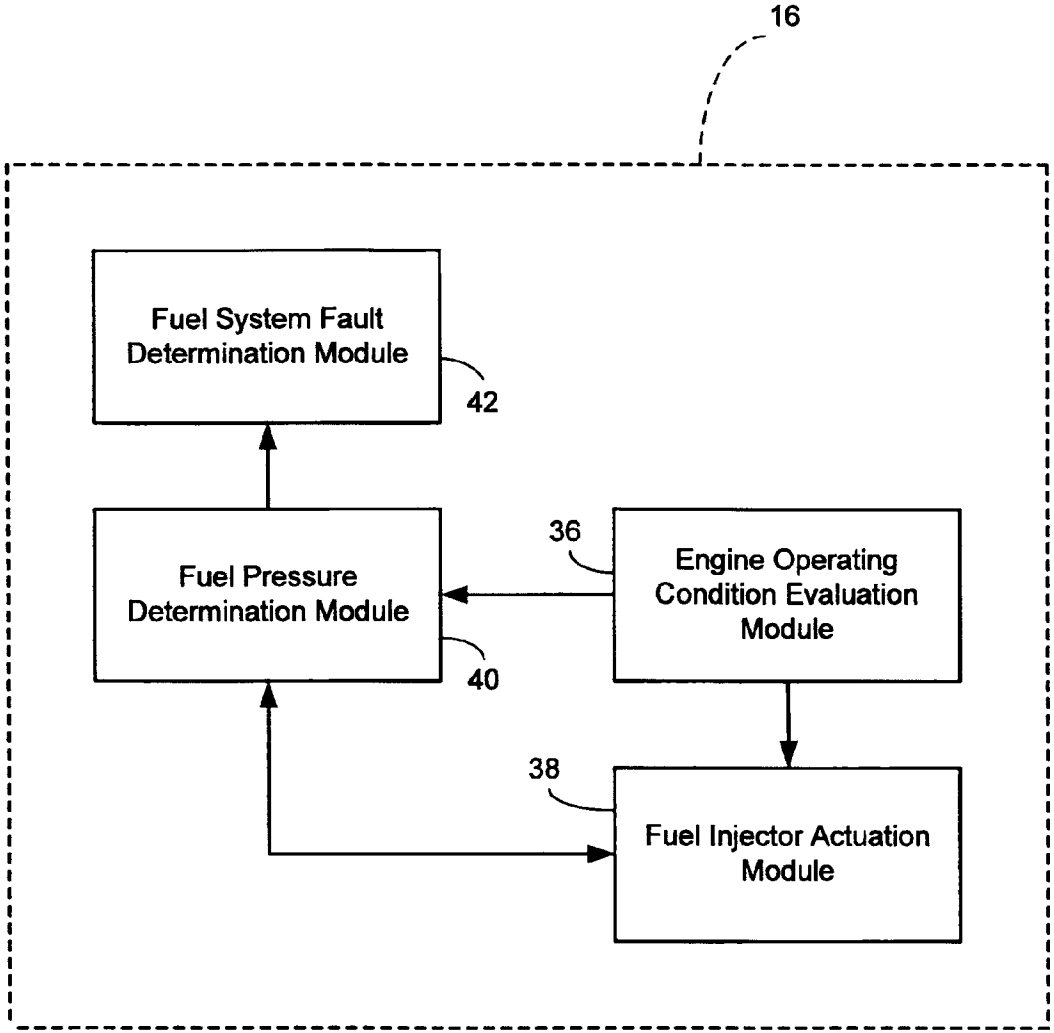
FIG. 2 is a schematic illustration of a control module of the engine assembly of FIG. 1.

Referring now to FIG. 2, the control module 16 may include an engine operating condition evaluation module 36, a fuel injector actuation module 38, a fuel pressure determination module 40, and a fuel system fault determination module 42. The engine operating condition evaluation module 36 may be in communication with the fuel injector actuation module 38 and the fuel pressure determination module 40 and may determine an engine on/off condition. An engine on condition may generally correspond to pistons within the cylinders 20 being driven by combustion events within the cylinders 20. The engine off condition may generally correspond to the pistons within the cylinders 20 being stationary. The engine operating condition evaluation module 36 may provide a signal to the fuel injector actuation module 38 and the fuel pressure determination module 40 indicative of the engine on/off condition.

The fuel injector actuation module 38 and the fuel pressure determination module 40 may be in communication with one another. The fuel pressure determination module 40 may additionally be in communication with the fuel pressure sensor 32 and may determine an operating fuel pressure within the fuel volume (V). The fuel pressure determination module 40 may provide a signal to the fuel injector actuation module 38 indicative of the operating fuel pressure and the fuel injector actuation module 38 may provide a signal to the fuel pressure determination module 40 indicating when the fuel injectors 30 have been actuated. The fuel pressure determination module 40 may additionally be in communication with the fuel system fault determination module 42. The fuel system fault determination module 42 may determine a system fault based on the operating fuel pressure as discussed below.

Figure 3:
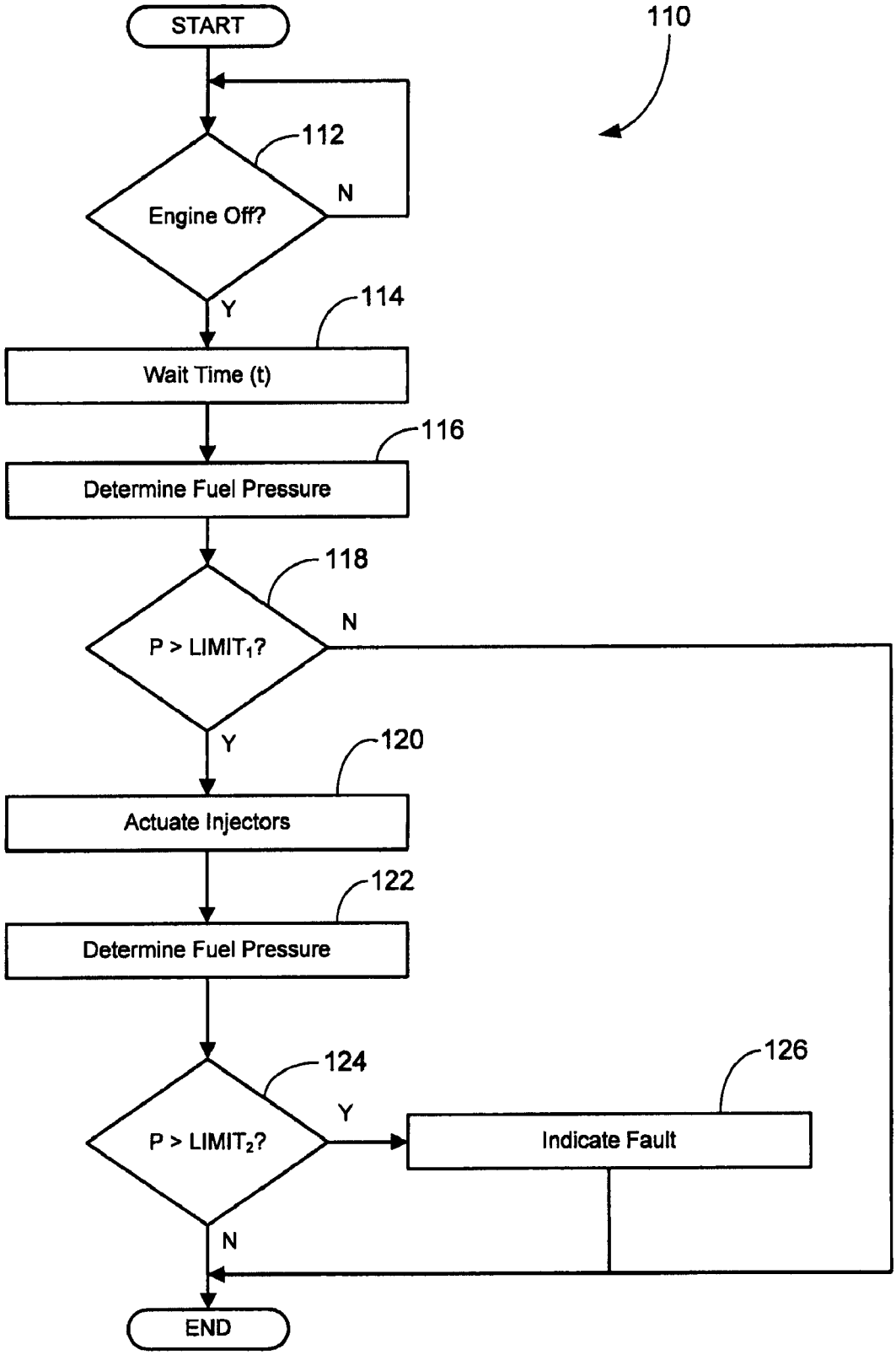
FIG. 3 is an illustration of control logic for operation of the engine assembly of FIG. 1.

Referring now to FIG. 3, control logic 110 is illustrated for fuel system control. Control logic 110 may begin at block 112 where the engine operating condition is evaluated by the engine operating condition evaluation module 36. If the engine 12 is on, control may return to block 112. If the engine 12 is off, control logic 110 may proceed to block 114 and wait a predetermined time (t). Control logic 110 may then proceed to block 116 where fuel pressure determination module 40 determines the fuel pressure (P) within the fuel volume (V). Control logic 110 may then proceed to block 118 where the fuel pressure (P) is evaluated by fuel injector actuation module 38. If the fuel pressure (P) is below a first predetermined pressure limit ($LIMIT_1$), control logic 110 may terminate. Otherwise, control logic 110 may proceed to block 120 where at least one of the fuel injectors 30 is actuated by the fuel injector actuation module 38. The fuel injectors 30 may be actuated for 100 microseconds or more at block 120. The control logic 110 may actuate as few as one and as many as all of the fuel injectors 30 at block 120. Control logic 110 may then proceed to block 122.

Fuel pressure determination module 40 may again determine the fuel pressure (P) within the fuel volume (V) at block 122. Control logic 110 may then proceed to block 124 where the fuel pressure (P) is evaluated by fuel system fault determination module 42. If the fuel pressure (P) is above a second predetermined pressure limit ($LIMIT_2$), control logic 110 may proceed to block 126 where a fault is indicated. The fault may generally indicate a faulty pressure sensor 32. Control logic 110 may then terminate. If the fuel pressure (P) is below the second predetermined pressure limit ($LIMIT_2$), control logic 110 may terminate after block 124. The first predetermined pressure limit ($LIMIT_1$) and the second predetermined pressure limit ($LIMIT_2$) may be equal to one another and may be less than or equal to 5 MPa.

After the engine 12 is shut down, the pressure within the fuel volume (V) may gradually be reduced via leakage through the fuel injectors 30. The predetermined time (t) may correspond to an expected pressure drop ($\Delta P_e$) producing the first and second predetermined pressure limits ($LIMIT_1$, $LIMIT_2$) in the fuel volume (V) after engine shutdown. The predetermined time (t) may be empirically derived and may vary based on a given engine application. However, by way of non-limiting example, the predetermined time may be greater than 15 seconds, and more specifically greater than 30 seconds. The expected pressure drop ($\Delta P_e$) may generally correspond to a pressure drop from an engine idle condition immediately prior to shutdown. For example, the fuel volume (V) may be operating at approximately 30 MPa at idle and the expected pressure after time (t) may be less than 5 MPa. Therefore, in the present example, the expected pressure drop ($\Delta P_e$) may be approximately equal to 25 MPa.

Different fuel types may have difficulty leaking through the fuel injectors 30 after engine shutdown, maintaining a high pressure within the fuel volume (V). For example, biodiesel and contaminated fuel may have difficulty leaking through the fuel injectors 30. Therefore, fuel pressure within the fuel volume (V) may remain high after engine shutdown. Actuation of the fuel injectors 30 after engine shutdown may generally alleviate any high pressure condition maintained due to the issues described about with respect to fuel leak rates. However, high pressure readings may still occur even after the actuation of the fuel injectors 30 due to a faulty pressure sensor 32.

What is claimed is:

1. A method comprising:

determining when an engine transitions from an engine on condition to an engine off condition;

determining a first fuel pressure in a direct injection fuel system of the engine a predetermined time after the determined engine off condition; and actuating a fuel injector of the direct injection fuel system during the engine off condition when the first determined fuel pressure is above a first predetermined pressure limit to bleed fuel from the direct injection fuel system and reduce pressure within the direct injection fuel system to a pressure below the first predetermined pressure limit.

2. The method of claim 1, wherein the first fuel pressure is determined in a fuel rail of the direct injection fuel system.

3. The method of claim 2, wherein the direct injection fuel system operates at a fuel pressure of at least 30 megapascal (MPa) within the fuel rail during the engine on condition.

4. The method of claim 3, wherein the first predetermined pressure limit is less than or equal to 5 MPa.

5. The method of claim 1, wherein the actuating includes actuating the fuel injector for at least 100 microseconds.

6. The method of claim 1, further comprising determining a second fuel pressure in the direct injection fuel system after the actuating and indicating a system fault when the second fuel pressure is above a second predetermined pressure limit.

7. The method of claim 6, wherein the system fault indicates a faulty pressure sensor.

8. The method of claim 6, wherein the second predetermined pressure limit is equal to the first predetermined pressure limit.

9. The method of claim 1, wherein the predetermined time and the first predetermined pressure limit are empirically determined based on a fuel leak rate through the fuel injector when the fuel injector is in a non-actuated state.

10. A method comprising:

determining when an engine transitions from an engine on condition to an engine off condition;

determining a first fuel pressure in a direct injection fuel system of the engine a predetermined time after the determined engine off condition;

actuating a fuel injector of the direct injection fuel system during the engine off condition when the first determined fuel pressure is above a first predetermined pressure limit to bleed fuel from the direct injection fuel system and reduce pressure within the direct injection fuel system to a pressure below the first predetermined pressure limit;

determining a second fuel pressure in the direct injection fuel system after the actuating; and indicating a system fault when the second fuel pressure is above a second predetermined pressure limit.

11. The method of claim 10, wherein the predetermined time and the first and second predetermined pressure limits are empirically determined based on a fuel leak rate through the fuel injector when the fuel injector is in a non-actuated state.

12. A control module comprising:

an engine operating condition evaluation module that determines when an engine transitions from an on condition to an off condition;

a fuel pressure determination module in communication with the engine operating condition evaluation module that determines a first fuel pressure in a direct injection fuel system of the engine a predetermined time after the determined engine off condition; and a fuel injector actuation module in communication with the fuel pressure determination module that actuates a fuel injector of the direct injection fuel system during the engine off condition when the first determined fuel pressure is above a first predetermined pressure limit to bleed fuel from the direct injection fuel system and reduce pressure within the direct injection fuel system to a pressure below the first predetermined pressure limit.

13. The control module of claim 12, wherein the fuel pressure determination module determines the fuel pressure within a fuel rail of the direct injection fuel system.

14. The control module of claim 13, wherein the direct injection fuel system operates at a fuel pressure of at least 30 megapascal (MPa) within the fuel rail during the engine on condition.

15. The control module of claim 14, wherein the first predetermined pressure limit is less than or equal to 5 MPa.

16. The control module of claim 12, wherein the fuel injector actuation module actuates the fuel injector for at least 100 microseconds.

17. The control module of claim 12, further comprising a fuel system fault determination module in communication with the fuel pressure determination module, the fuel pressure determination module determining a second fuel pressure in the direct injection fuel system after the actuating and the direct injection fuel system fault determination module indicating a system fault when the second fuel pressure is above a second predetermined pressure limit.

18. The control module of claim 17, wherein the system fault indicates a faulty pressure sensor.

19. The control module of claim 18, wherein the second predetermined pressure limit is equal to the first predetermined pressure limit.

20. The control module of claim 12, wherein the predetermined time and the first predetermined pressure limit are empirically determined based on a fuel leak rate through the fuel injector when the fuel injector is in a non-actuated state.

* * * * *